US005497876A

United States Patent [19]

Fleming

[11] Patent Number: 5,497,876

[45] Date of Patent: Mar. 12, 1996

[54] COMBINATION GIFT BOX, GREETING CARD, WRAPPING AND DECORATION

[76] Inventor: Barbara D. Fleming, P.O. Box 1630, Pomona, Calif. 91769-1630

[21] Appl. No.: 398,775

[22] Filed: Mar. 6, 1995

Related U.S. Application Data

[63] Continuation-in-part of Ser. No. 136,262, Oct. 15, 1993, abandoned.

[51] Int. Cl.[6] ..... B65D 69/00

[52] U.S. Cl. ..... 206/232; 206/45.28; 206/45.29; 40/312

[58] Field of Search ..... 206/45.28, 45.29, 206/457, 232; 229/92.8, 922, 923; 40/312, 313

[56] References Cited

U.S. PATENT DOCUMENTS

| | | | |
|---|---|---|---|
| Re. 33,503 | 12/1990 | Schluger | 206/232 |
| 1,143,729 | 6/1915 | Schmidt | 206/232 |
| 1,628,121 | 5/1927 | Covel | 206/457 |
| 2,241,673 | 5/1941 | Mogabgab | 206/232 |
| 2,344,437 | 3/1944 | Lande | 206/232 |
| 2,799,391 | 7/1957 | Eisner | 206/232 |
| 3,141,549 | 7/1964 | Koehler | 206/232 |
| 4,566,592 | 1/1986 | Klukos | 206/232 |
| 4,614,266 | 9/1986 | Moorhead | 229/923 |
| 4,726,509 | 2/1988 | Fonas | 206/457 |
| 5,004,144 | 4/1991 | Selga | 206/457 |
| 5,004,271 | 4/1991 | Piatt | 206/232 |
| 5,096,058 | 3/1992 | Juravin et al. | 206/232 |
| 5,226,532 | 7/1993 | Davidson et al. | 206/232 |
| 5,232,087 | 8/1993 | Schluger | 206/232 |

FOREIGN PATENT DOCUMENTS

| | | | |
|---|---|---|---|
| 455048 | 11/1991 | European Pat. Off. | 206/232 |

*Primary Examiner*—David T. Fidei
*Attorney, Agent, or Firm*—Richard L. Huff

[57] ABSTRACT

A combination gift box, greeting card, and wrapping is prepared from a one-piece blank wherein a decorative design is present on the surfaces of the blank which will make up the outer surfaces of the box. The box has a double cover. When the top section of the cover is lifted, a greeting card is exposed. When the entire cover is lifted, the contents of the box are exposed. A permanent or temporary three-dimensional decoration is attached to the cover of the box.

6 Claims, 10 Drawing Sheets

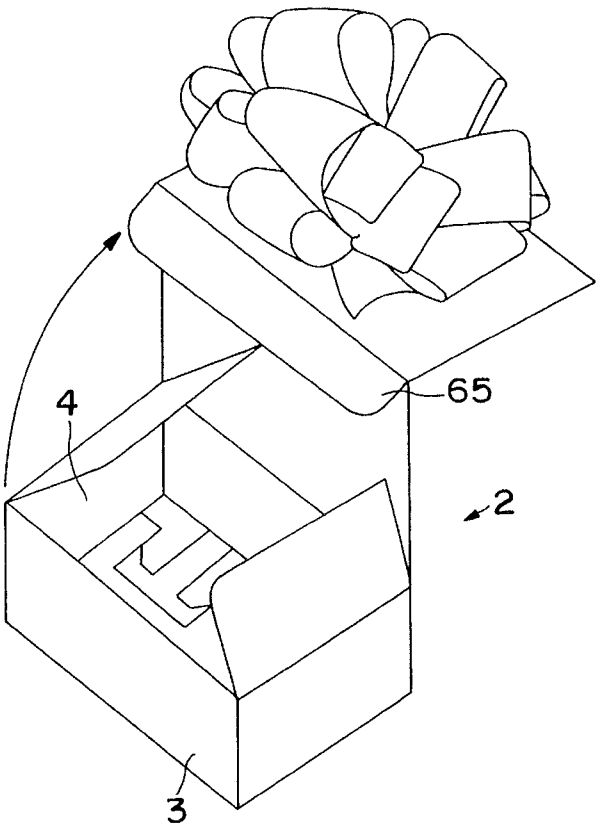
FIG. IC
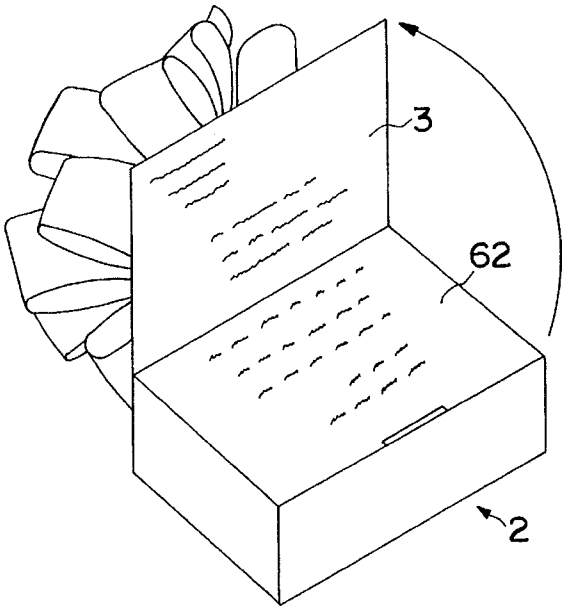
FIG. IB
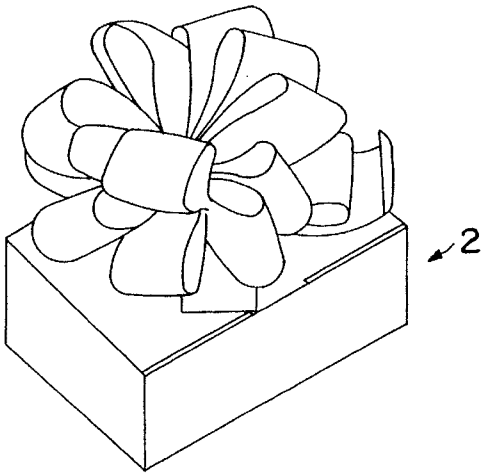
FIG. IA

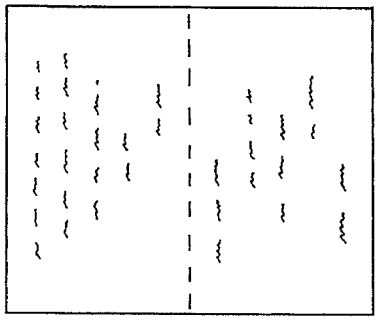
FIG. IG
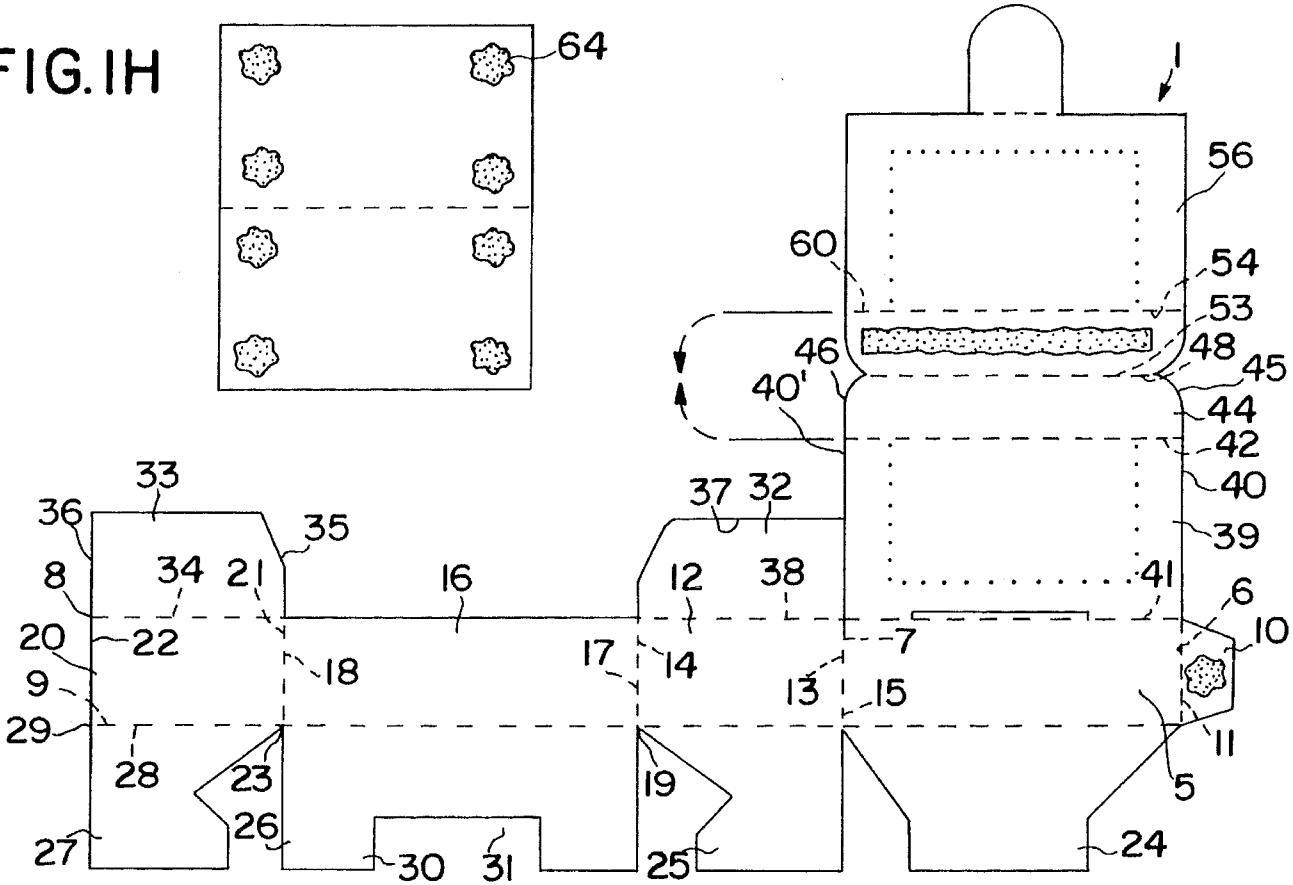
FIG. IF
FIG. IH

COMBINATION GIFT BOX, GREETING CARD, WRAPPING AND DECORATION

CROSS-REFERENCE TO RELATED APPLICATIONS

This application is a continuation-in-part of application Ser. No. 08/136,262, filed Oct. 15, 1993, now abandoned.

BACKGROUND OF THE INVENTION

1. Field of the Invention

The present invention relates to a gift container which includes a decorative housing and a greeting card.

2. Description of the Related Art

In the past, gifts have been given within decorative covers, e.g. paper, along with additional enhancements, such as bows, ribbons, and fillers. A greeting card, addressing the occasion for the gift, would be included. This has resulted in the gift-giver having to make separate purchases for each of these items. Also, the gift-giver would have to employ some packaging skills in order to assure a neat and attractive final product. Usually, left-over materials, such as paper and ribbons, would have to be disposed of or stored.

U.S. Pat. No. 2,344,437 to Lande and EP 455 048 to Lo Duca disclose boxes containing supplemental tops which contain writing. In the Lande box, the supplemental top abuts and rotates around one of the sides, the box does not contain a wrapping design, and there is no three-dimensional decoration affixed to the supplemental top. These observations apply to the box of Lo Duca. Additionally, the box of Lo Duca is not disclosed as being a gift box, but rather a box for the transportation of pharmaceuticals.

SUMMARY OF THE INVENTION

This invention has for its object the elimination of the above-noted disadvantages of the prior art products while providing an attractive one-piece decorative gift container with enhancements, such as paper and ribbon, and an incorporated greeting card.

Another object is the offering of an alternative gift container which eliminates the necessity for separate selection and purchase of decorative coverings, enhancements, and greeting cards.

A further object is to reduce the amount of time spent in selection of all the separate items necessary for a traditional gift presentation, and to reduce the expense of purchasing all of the separate items needed to properly present a gift.

Further objects of this invention include the elimination of left-over decorative items requiring storage or disposal, and the production of an attractive gift box regardless of the gift-wrapping skills of the gift-giver.

In order to accomplish the above objectives, this invention is directed to a box prepared from a single-piece blank. The box has a bottom, four sides, a top, and a supplemental top. The top abuts and rotates around a top edge of the front side. The supplemental top abuts and rotates around a free edge of the top. In an alternative design, the top abuts, and rotates about the top edge of the rear side panel and the supplemental top abuts and rotates about a side edge of the top. The outer aspect of the box contains wrapping designs. The outer aspect of the supplemental top contains a three-dimensional decorative attachment. The box of the invention contains a greeting card which presents itself when the supplemental top is opened.

BRIEF DESCRIPTION OF THE DRAWINGS

The accompanying drawings, which are incorporated in and constitute a part of this specification, illustrate examples of preferred embodiments of the invention and, together with the description, serve to explain the principles of the invention.

FIG. 1A is a perspective view of the front aspect of a closed box of this invention having a permanent three-dimensional decoration.

FIG. 1B is a perspective view of the front aspect of the box having the supplemental top open to present a greeting card.

FIG. 1C is a perspective view of the rear aspect of a box of this invention showing both the top and the supplemental top opened to expose the greeting card and the contents of the box.

FIG. 1F is a plan view of a blank used in forming a combined greeting card and box of the present invention showing the inner surface of the sides of the box.

FIG. 1G is a plan view of the front of a greeting card insert which may be used in lieu of a permanent greeting card printed onto the top and supplemental top of the box.

FIG. 1H is a plan view of the rear of the card insert depicted in FIG. 1G.

DESCRIPTION OF THE PREFERRED EMBODIMENTS

Figures 1D, 1E:
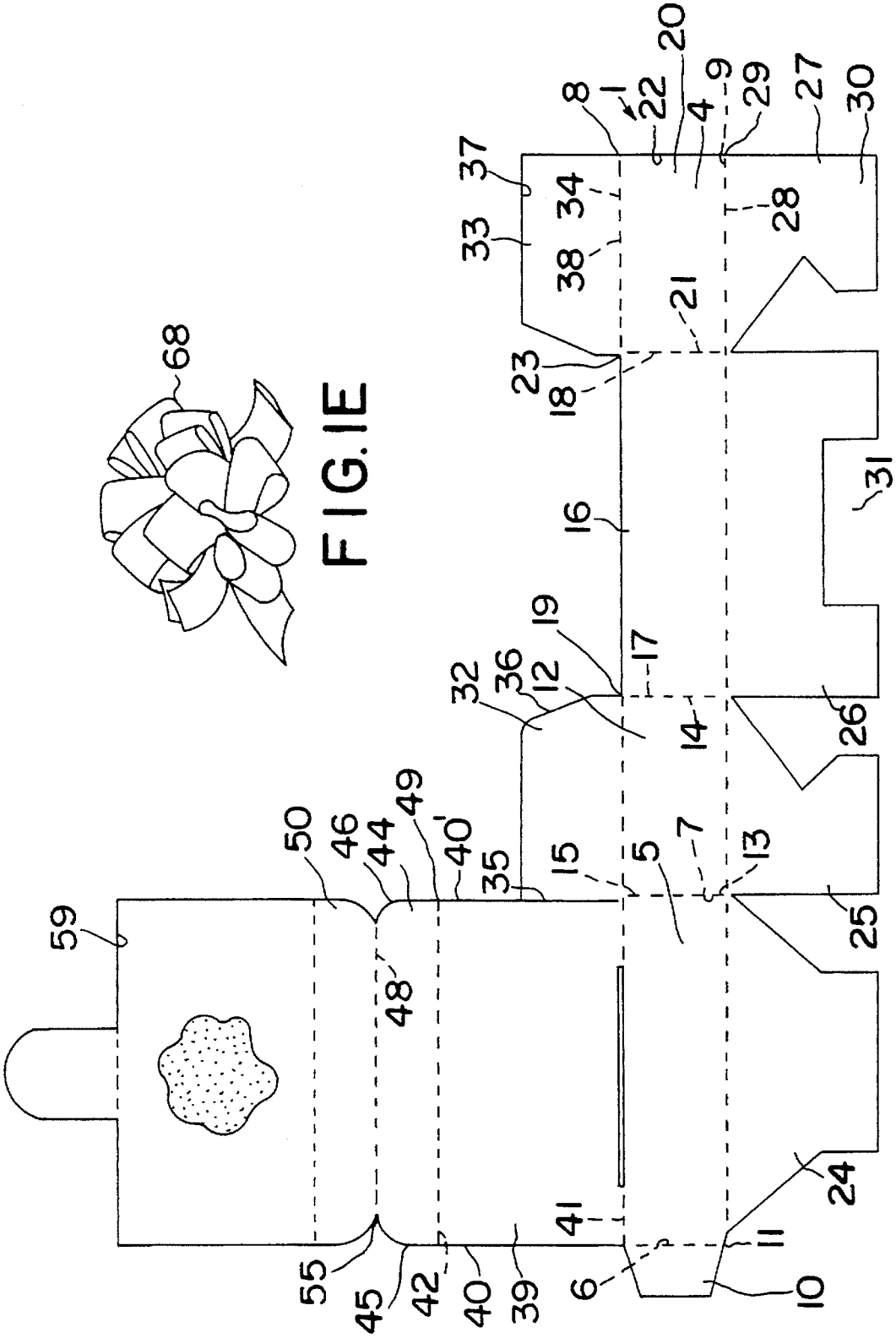
FIG. 1D is a plan view of a blank used in forming a combined greeting card and box of the present invention showing the outer surface of the sides of the box.
FIG. 1E is a side view of a three-dimensional decoration which may be permanently attached to the top surface of the supplemental top of the box of this invention.
Figure 2C:
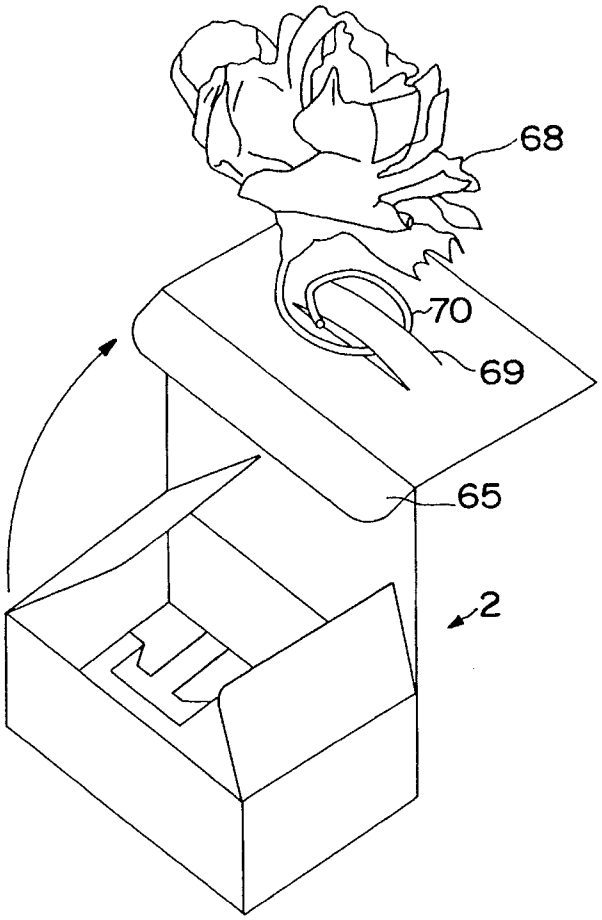
FIG. 2C is a perspective view showing the rear aspect of a box of this invention wherein a three-dimensional decoration is temporarily attached and both the top and supplemental top are opened to expose the greeting card and contents of the box.
Figure 2B:
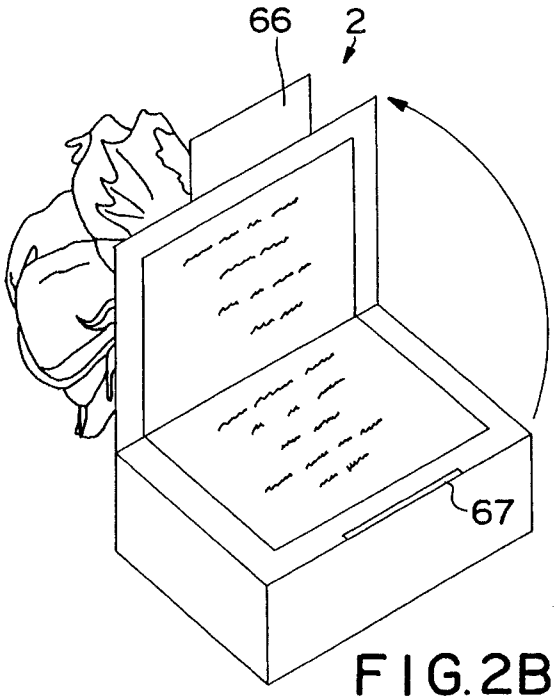
FIG. 2B is a perspective view showing the front aspect of the box of FIG. 2A wherein the supplemental top is opened to present a greeting card.
Figure 2A:
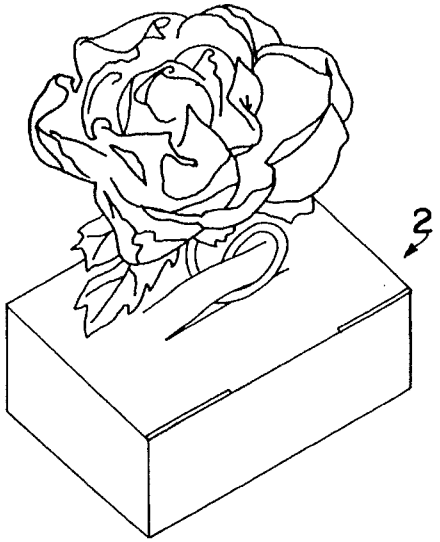
FIG. 2A is a perspective view of the front aspect of a closed box according to this invention wherein a three-dimensional decoration is temporarily attached to the top surface of the supplemental top of a box according to this invention.
Figure 2E:
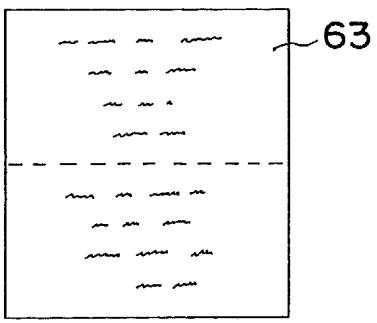
FIG. 2E is a plan view of a greeting card face insert which may be attached to the top and supplemental top of the box of this invention.
Figure 2F:
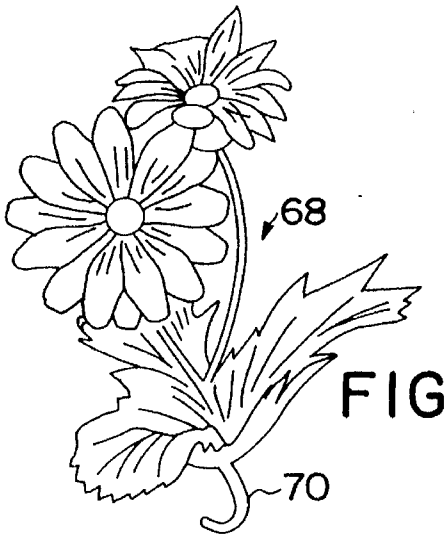
FIG. 2F is a side view of a temporary three-dimensional decoration which may be attached to the box as shown in FIG. 2C.
Figure 2D:
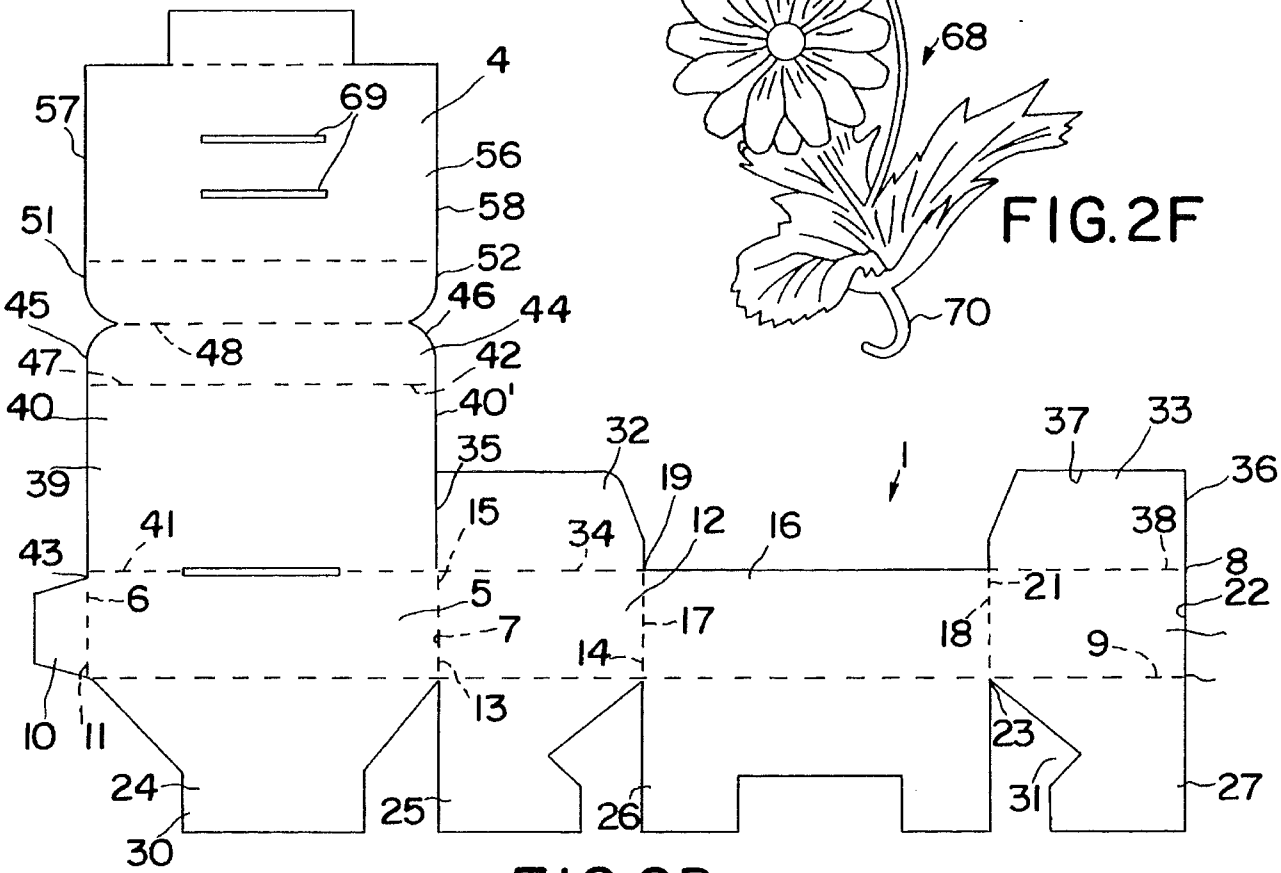
FIG. 2D is a plan view of a blank used in forming a box of this invention in which the supplemental top contains slits for the temporary attachment of a three-dimensional decoration showing the inner surface of the sides of the box.
Figure 2H:
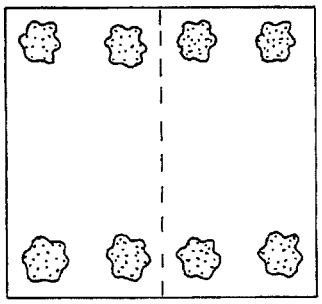
FIG. 2H is a plan view of the rear surface of a greeting card to be attached to the top and supplemental top of the box of this invention.
Figure 2G:
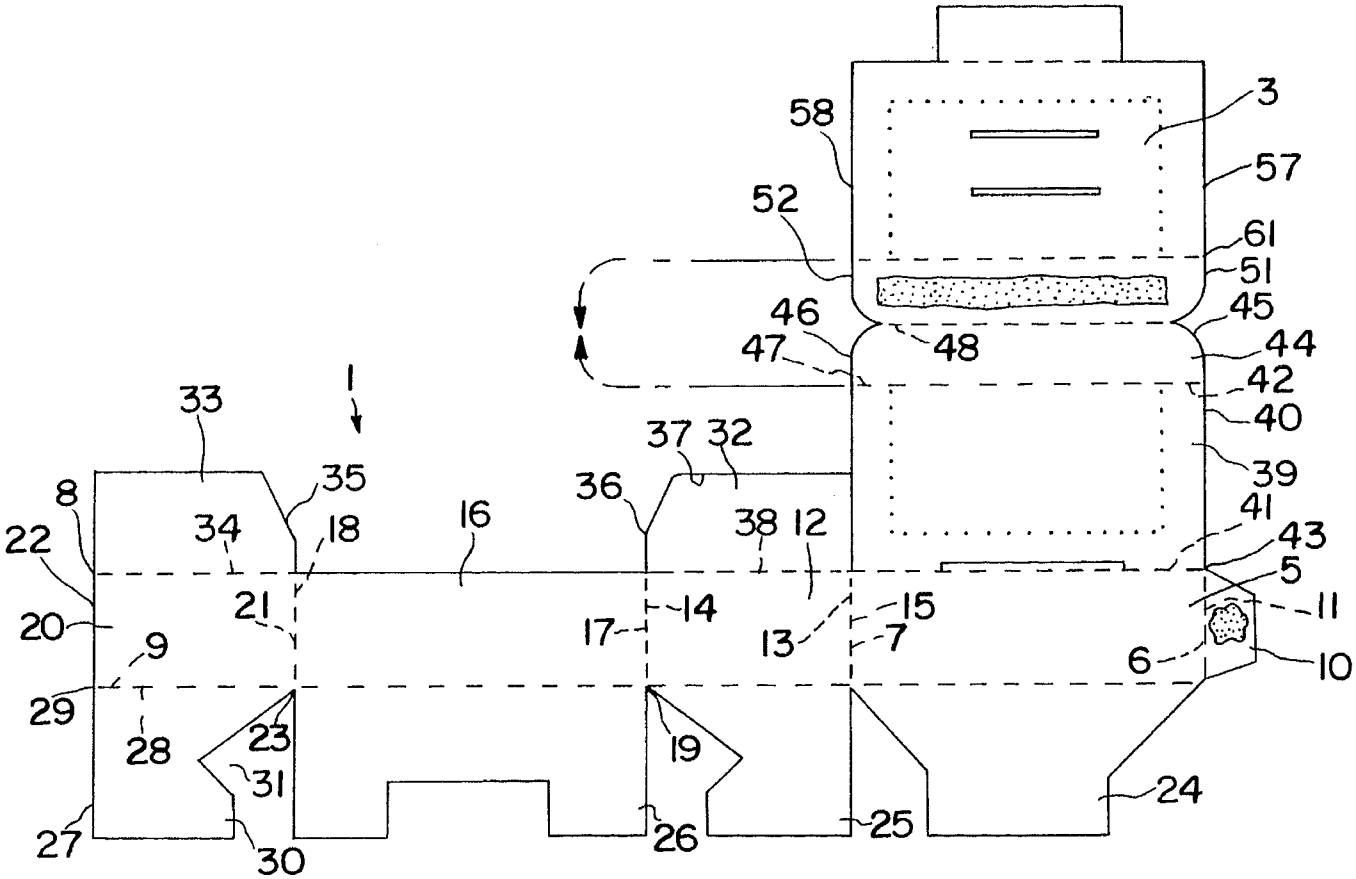
FIG. 2G shows a plan view of a blank used in forming a box of this invention in which the supplemental top contains slits for the temporary attachment of a three-dimensional decoration showing the outer surface of the sides of the box.
Figure 3C:
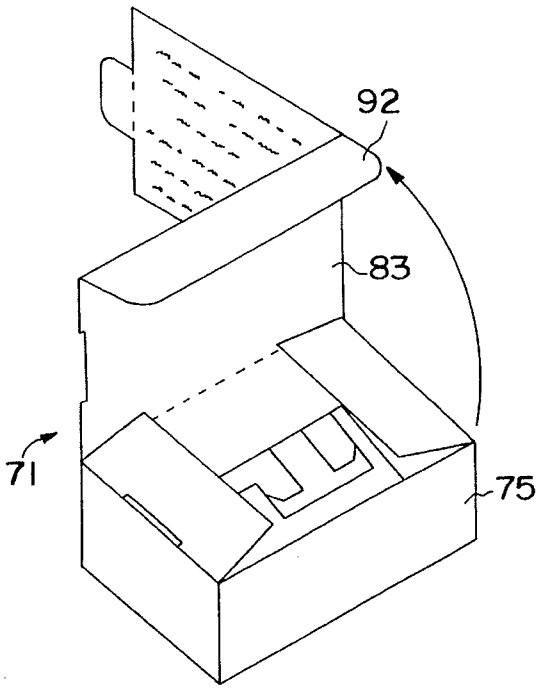
FIG. 3C is a perspective view showing the front aspect of the box of FIG. 3B with the supplemental top and the top in the open positions.
Figure 3B:
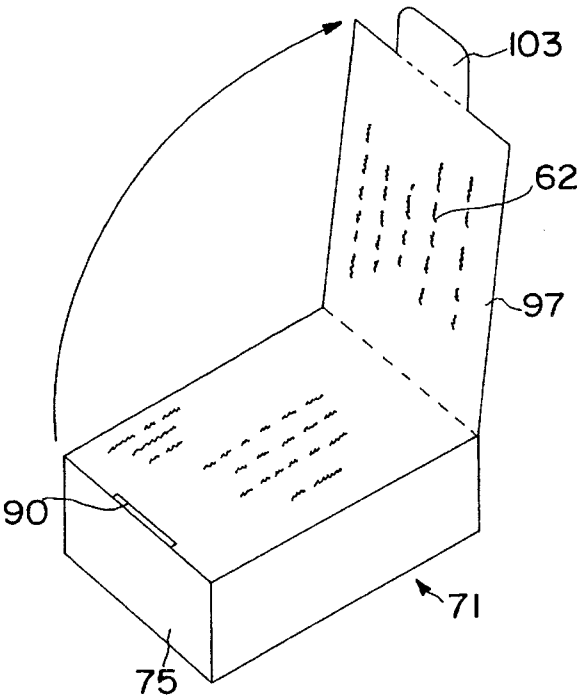
FIG. 3B shows a perspective view of a box of this option wherein the supplemental top is open to present the greeting card.
Figure 3A:
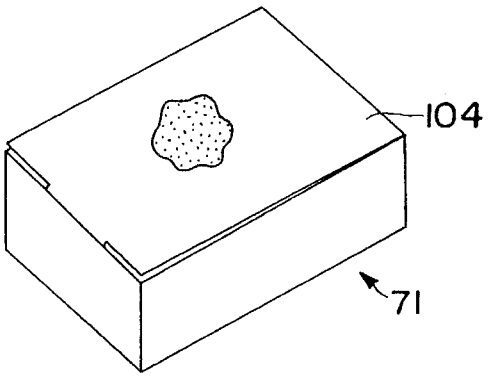
FIG. 3A shows a perspective view of the front aspect of a closed box showing another option of this invention.
Figure 3D:
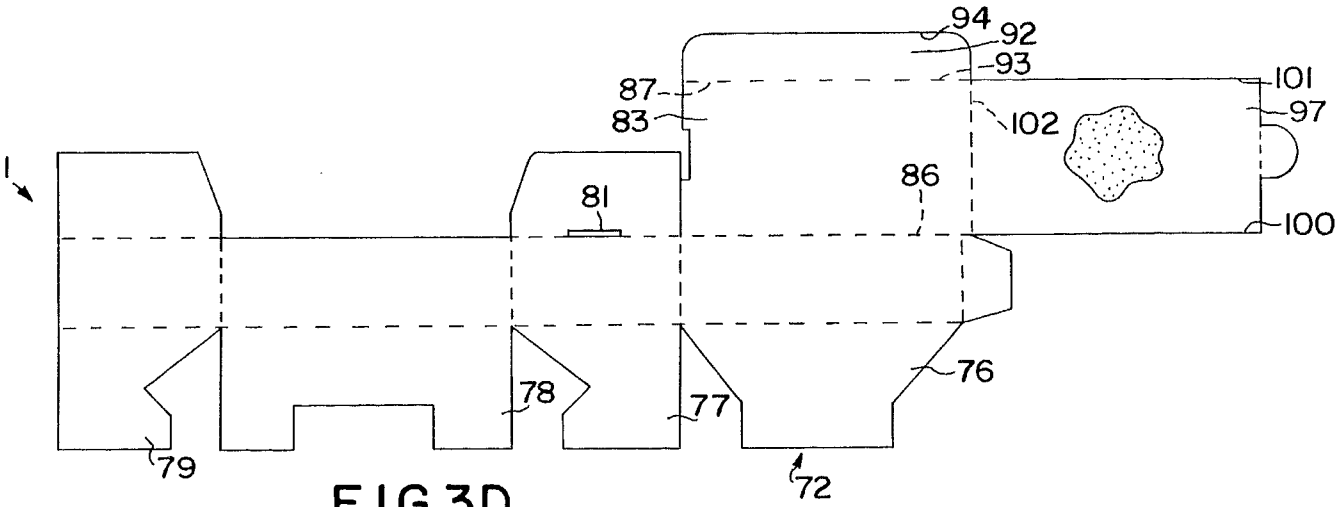
FIG. 3D is a plan view showing the inner side surfaces of a blank for preparing a box of this invention according to the option shown in FIG. 3B.
Figure 3F:
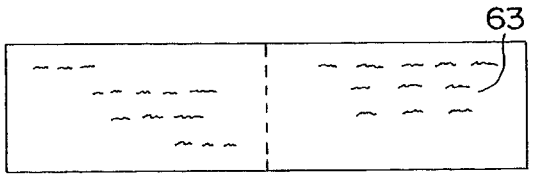
FIG. 3F shows a plan view of a greeting card insert for use in the box shown in FIG. 3B.
Figure 3E:
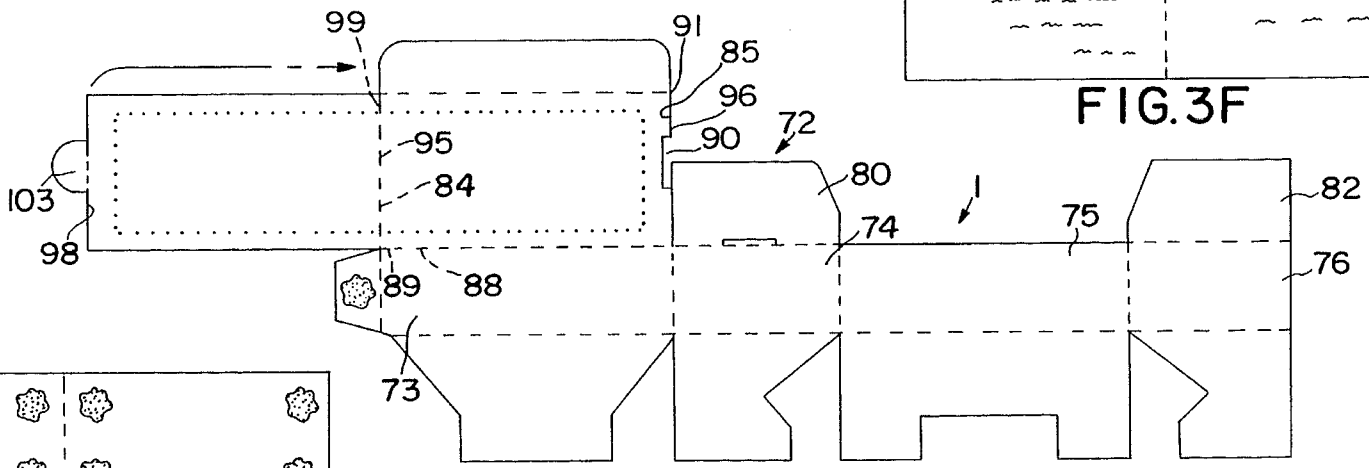
FIG. 3E is a plan view showing the outer side surfaces of a blank for preparing a box of this invention according to the option shown in FIG. 3B.
Figure 3G:
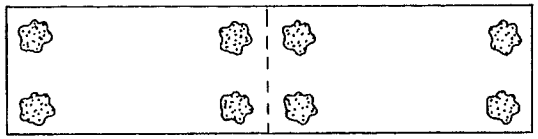
FIG. 3G shows an adhesive option for the attachment of a three-dimensional decoration.
Figure 4D:
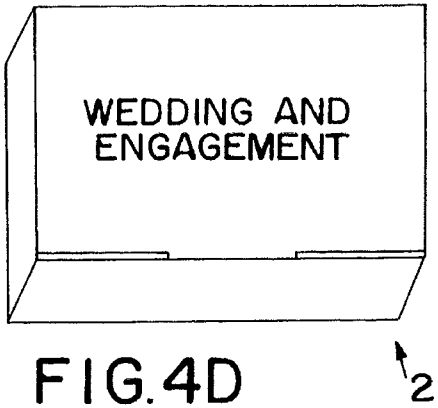
FIGS. 4A to 4E and FIGS. 5A to 5E show perspective views of boxes of this invention with special occassions indicated on the supplemental top. Three-dimensional decorations appropriate to the occassions would be temporarily or permanently placed on the outer surface of the supplemental top.
Figure 4E:
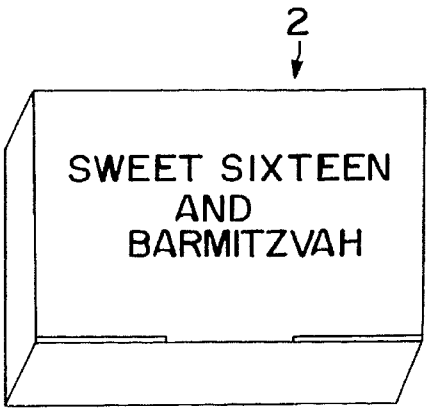
Figure 4C:
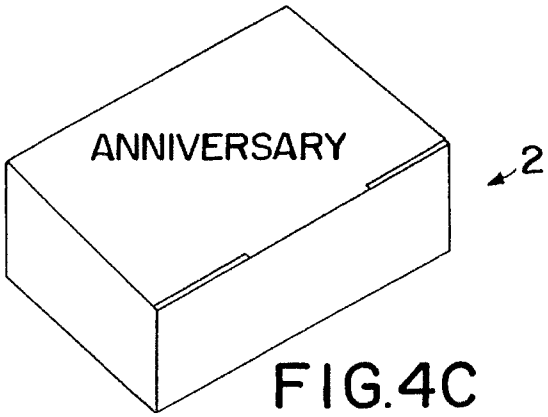
Figure 4A:
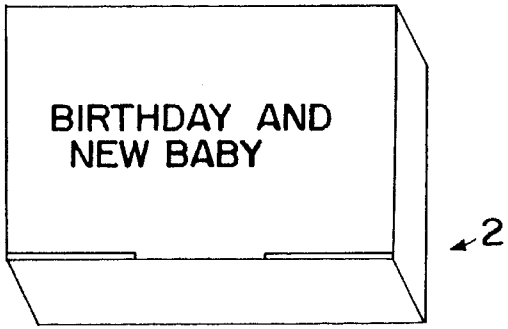
Figure 4B:
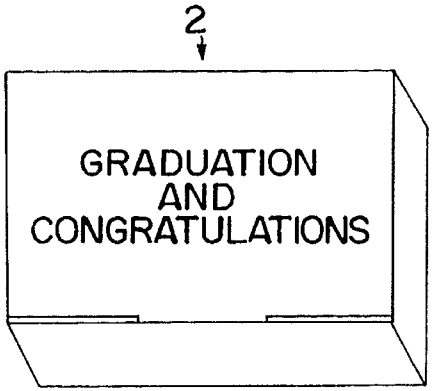
Figure 5A:
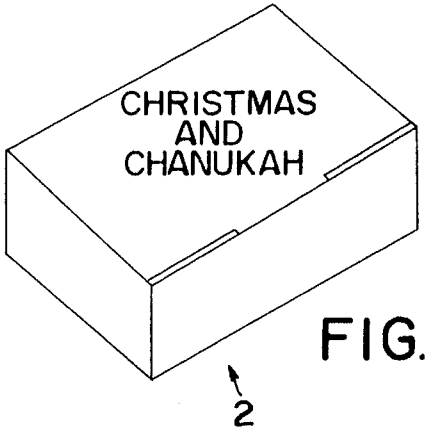
Figure 5B:
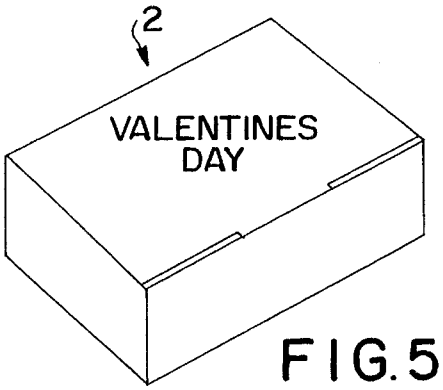
Figure 5C:
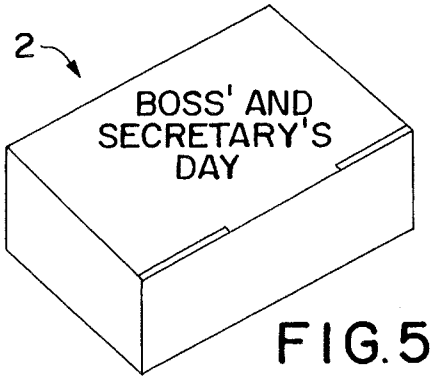
Figure 5D:
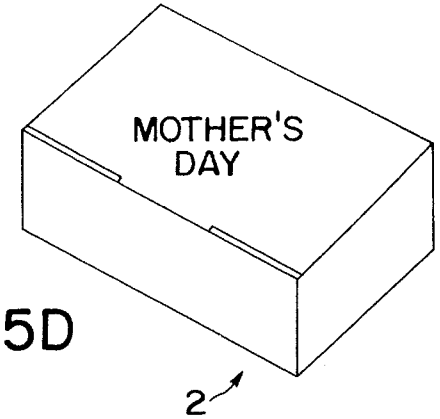
Figure 5E:
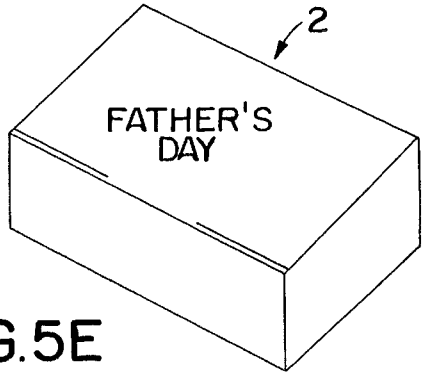

With reference now to the drawings, wherein like reference characters designate like or corresponding parts throughout the several drawings, there is now described a combination box, greeting card, wrapping and decoration according to the invention.

A blank 1 for a single-piece combination gift box and greeting card 2 is prepared, which blank 1 comprises:

a sheet member of rigid materials, preferably cardboard stock, having a first surface 3 and a second surface 4 and containing:

(a) a first (front) side panel 5 containing first 6 and second 7 side edges, a top edge 8, and a bottom edge 9, the first side edge 6 being connected to a side tab 10 at a line which is suitable for folding 11;

(b) a second side panel 12 containing first 13 and second 14 side edges, a top edge 8, and a bottom edge 9, the second side edge 7 of the first side panel 5 and the first side edge 13 of the second side panel 12 abutting at a line which is suitable for folding 15;

(c) a third (rear) side panel 16 containing first 17 and second 18 side edges, a top edge 8, and a bottom edge 9, the second side edge 14 of the second side panel 12 and the first side edge 17 of the third side panel 16 abutting at a line which is suitable for folding 19;

(d) a fourth side panel 20 containing first 21 and second 22 side edges, a top edge 8, and a bottom edge 9, the second side edge 18 of the third side panel 16 and the first side edge 21 of the fourth side panel 20 abutting at a line which is suitable for folding 23;

(e) first 24, second 25, third 26, and fourth 27 bottom panels, each bottom panel containing a top edge 28 which abuts the bottom edge 9 of the first 5, second 12, third 16, and fourth 20 side panel, respectively, at a line which is suitable for folding 29, each of said bottom panels 24 25 26 27 containing a tab 30 or a notch 31, which tabs 30 and notches 31 are so arranged as to form a sturdy bottom when fitted together;

(f) a second top panel 32 and a third top panel 33, each panel containing a bottom edge 34, first 35 and second 36 side edges, and a top edge 37, the top edge 8 of the second side panel 12 and the top edge 8 of the fourth side panel 20 abutting the bottom edge 34 of the second top panel 32 and the bottom edge 34 of the third top panel 33, respectively, at lines which are suitable for folding 38;

(g) a first top panel 39 containing two side edges 40 40', a bottom edge 41, and a top edge 42, the top edge 8 of the first (front) side panels 5 and the bottom edge 41 of the first top panel 39 abutting at a line which is suitable for folding 43;

(h) a lower fold panel 44 containing first 45 and second 46 side edges, a bottom edge 47, and a top edge 48, the bottom edge 47 of the lower fold panel 44 abutting the top edge 42 of the first top panel 39 at a line which is suitable for folding 49;

(i) an upper fold panel 50 containing first 51 and second 52 side edges, a bottom edge 53, and a top edge 54, the bottom edge 53 of the upper fold panel 50 abutting the top edge 48 of the lower fold panel 44 at a line which is suitable for folding 55;

(j) a fourth (supplemental) top panel 56 containing first 57 and second 58 side edges, a top edge 59, and a bottom edge 60, the bottom edge 60 of the fourth top panel 56 abutting the top edge 54 of the upper fold panel 50 at a line which is suitable for folding 61.

The first surfaces 3 of the first top panel 39 and the fourth (supplemental) top panel 56 are imprinted so as to present a greeting card message 62. It is intended that there be a wide selection of messages 62, suitable for special occassions. Alternatively, this portion of the box may be left blank and a greeting card 62 from a variety of greeting cards 62 especially made and correctly sized for the box may be positioned on these surfaces by paste, glue, or other adhesive 64.

The first surfaces 3 of the second 32 and third 33 top panels, the side panels 5 12 16 20, and bottom panels 24 25 26 27 and the second surfaces 4 of the first 39 and fourth (supplemental) 56 top panels and the lower 44 and the upper 50 fold panels contain decorative designs (not shown).

The decorative designs may be imprinted on the surfaces or may be in the form of decorative paper adhered to the surfaces. Additionally, ribbons may be pressed on the surfaces in a known manner or secured to the surfaces by adhesives.

The surfaces of the box may be square or rectangular, and it is intended that a wide variety of sizes be available.

The blank 1 is readily assembled by folding along the edges which are suitable for folding. Such edges are preferably scored or perforated. The tabs 30 and notches 31 are easily secured.

The top (the first top panel) 39 abuts with, and rotates about, the third (front) side panel 16.

The juncture of the lower 44 and upper 50 fold panels will form the leading edge of a rear tab 65. The juncture of the first top panel 39 and the lower fold panel 44 will meet with the juncture of the fourth top panel (supplemental top) 56 and the upper fold panel 50 to form the base of a rear tab 65. Thus, the lower 44 and upper 50 fold panels, when folded, become a tab of double thickness (rear tab) 65 which will fit inside the top edge 8 of the third (rear) side panel 16 to secure the top 39 in a closed position.

The supplemental top (the fourth top panel) 56 abuts with, and rotates about, the junction formed by the two bases of the rear tab 65 and the top edge 42 of the first top panel 39.

In one alternative of this invention, the top edge 59 of the supplemental top (fourth top panel) 56 contains a tab 66 which fits into a slit 67 formed between the first (front) side panel 5 and the top (first top panel) 39 to secure the supplemental top 56 in place. In a second alternative of this invention, at least one side edge 51 52 of the supplemental top 50 contains a tab (not shown) which fits into at least one slit (not shown) formed between the first edge 6 of the first side panel 5 and its appended tab or a slit (not shown) formed between the first 5 and second 12 side panels.

A three-dimensional decorative attachment 68 is attached to the second surface 4 of the supplemental top 56. This attachment may be permanent by means of paste, glue, or other adhesive, such as rubber adhesive. Alternatively, this attachment may be temporary. A temporary attachment is brought about by forming parallel slits 69 in the supplemental top 56 and attaching a three-dimensional decoration 68 by tying an elongated extension 70 of the three-dimensional decoration 68 to the parallel slits 69. When slits are made in the supplemental top 56, any greeting message 62 on that panel would be spoiled. Therefore, a greeting card face insert 63 is intended to be placed on the first surfaces 3 of the first 39 and fourth 56 top panels when a temporary attachment is used. In order to offer greater flexibility in the choice of greeting messages, greeting face inserts 63 may also be used with boxes 2 containing permanent three-dimensional attachments 68.

The 2 box just described is shown in main FIGS. 1.0 and 2.0. An alternative 71 to this box is shown in main FIG. 3, and is described below.

The assembly blank 72 of the alternative version 71 contains first (rear) 73, second 74, third (front) 75, and fourth 76 side panels and first 76, second 77, third 78, and fourth 79 bottom panels. There is a second top panel 80 above and abutting the second side panel 74, with a slit 81 formed between these two panels. There is a third top panel 82 above and abutting the fourth side panel 76.

A first top panel 83 containing first 84 and second 85 side edges, a bottom edge 86, and a top edge 87 abuts with the top edge 88 of the first (rear) side panel 73 along the bottom edge 86 of the first top panel 83 along a line that is suitable for folding 89. There is a centrally located notch 90 in the second edge 85 of the first top panel 83.

Abutting the top edge 87 of first top panel 83 along a line that is suitable for folding 91, is a front tab 92 having a bottom edge 93, a top edge 94, and first 95 and second 96 side edges. The front tab 92 will fit into the space formed between the third (front) side panel 75 and the first top panel 83.

A fourth top panel (supplemental top) 97 contains first 98 and second 99 side edges, a bottom edge 100, and a top edge 101. The second side edge 99 of the fourth top panel 97 abuts with the first side edge 84 of the first top panel 83 along a line that is suitable for folding 102. The first side edge 98 of the fourth top panel 97 contains a tab 103 suitable for fitting into the notch 90 in the second side edge 85 of the first top panel 83.

As in the first-described version of this invention, outer surfaces are printed with decorative designs or contain decorative paper and ribbon permanently attached thereto.

A three-dimensional decoration 68 is permanently or temporarily attached to the outer surface 104 of the supplemental top 97 as in the first version of this invention.

Upon opening the supplemental top 97, a greeting message 62 is presented. This message is either printed on the original blank 1 or is on a separate greeting card insert 63 which may be permanently attached to the common outer aspect of the top 83 and the inner aspect of the supplemental top 97.

I claim:

1. A blank for a single-piece combination gift box and greeting card comprising:

a sheet member of rigid material having a first surface and a second surface and containing:

(a) a first side panel containing first and second side edges, a top edge, and a bottom edge, the first side edge being connected to a side tab at a line which is suitable for folding;

(b) a second side panel containing first and second side edges, a top edge, and a bottom edge, the second side edge of the first panel and the first side edge of the second panel abutting at a line which is suitable for folding;

(c) a third side panel containing first and second side edges, a top edge, and a bottom edge, the second side edge of the second side panel and the first side edge of the third side panel abutting at a line which is suitable for folding;

(d) a fourth side panel containing first and second side edges, a top edge, and a bottom edge, the second side edge of the third side panel and the first side edge of the fourth side panel abutting at a line which is suitable for folding;

(e) first, second, third, and fourth bottom panels, each bottom panel containing a top edge which abuts the bottom edge of the first, second, third and fourth side panel, respectively, at a line which is suitable for folding, each of said bottom panels containing a tab or a notch, which tabs and notches are so arranged as to form a sturdy bottom when fitted together;

(f) a second top panel and a third top panel, each panel containing a bottom edge, first and second side edges, and a top edge, the top edge of the second side panel and the top edge of the fourth side panel abutting the bottom edge of the second top panel and the bottom edge of the third top panel, respectively, at lines which are suitable for folding;

(g) a first top panel containing two side edges, a bottom edge, and a top edge, the top edge of the first side panel and the bottom edge of the first top panel abutting at a line which is suitable for folding;

(h) a lower fold section containing first and second side edges, a bottom edge, and a top edge, the bottom edge of the lower fold section abutting the top edge of the first top panel at a line which is suitable for folding;

(i) an upper fold section containing first and second side edges, a bottom edge, and a top edge, the bottom edge of the upper fold section abutting the top edge of the lower fold section at a line which is suitable for folding;

(j) a fourth top panel containing first and second side edges, a top edge, and a bottom edge, the bottom edge of the fourth top panel abutting the top edge of the upper fold section at a line which is suitable for folding; wherein:

the fourth top panel contains at least one tab located on one or more of its side edges or upper edge, and there is a corresponding slit for each tab (a) at the juncture of the first side panel and the first top panel, (b) at the juncture of the second side panel and the second top panel and (c) at the juncture of the fourth side panel and the third top panel; and further:

(i) the first surfaces of the first top panel and the fourth top panel present a greeting card message; and (ii) the first surfaces of the second and third top panels, each of the side panels, and each of the bottom panels and the second surfaces of the first and fourth top panels and the lower and upper fold sections contain decorative designs.

2. A combination gift box and greeting card which is prepared by assembling the blank described in claim 1 and permanently adhering a three-dimensional decorative attachment to the second surface of the fourth top panel.

3. A blank for a single-piece combination gift box and greeting card comprising:

a sheet member of rigid material having a first surface and a second surface and containing:

(a) a first side panel containing first and second side edges, a top edge, and a bottom edge, the first side edge being connected to a side tab at a line which is suitable for folding;

(b) a second side panel containing first and second side edges, a top edge, and a bottom edge, the second side edge of the first panel and the first side edge of the second panel abutting at a line which is suitable for folding;

(c) a third side panel containing first and second side edges, a top edge, and a bottom edge, the second side edge of the second side panel and the first side edge of the third side panel abutting at a line which is suitable for folding;

(d) a fourth side panel containing first and second side edges, a top edge, and a bottom edge, the second side edge of the third side panel and the first side edge of the fourth side panel abutting at a line which is suitable for folding;

(e) first, second, third and fourth bottom panels, each bottom panel containing a top edge which abuts the bottom edge of the first, second, third and fourth side panel, respectively, at a line which is suitable for folding, each of said bottom panels containing a tab or a notch, which tabs and notches are so arranged as to form a sturdy bottom when fitted together;

(f) a second top panel and a third top panel, each panel containing a bottom edge, first and second side edges, and a top edge, the top edge of the second side panel and the top edge of the fourth side panel abutting the bottom edge of the second top panel and the bottom edge of the third top panel, respectively, at lines which are suitable for folding;

(g) a first top panel containing two side edges, a bottom edge, and a top edge, the top edge of the first side panel and the bottom edge of the first top panel partially abutting at a line which is suitable for folding;

(h) a lower fold section containing first and second side edges, a bottom edge, and a top edge, the bottom edge of the lower fold section abutting the top edge of the first top panel at a line which is suitable for folding;

(i) an upper fold section containing first and second side edges, a bottom edge, and a top edge, the bottom edge of the upper fold section abutting the top edge of the lower fold section at a line which is suitable for folding;

(j) a fourth top panel containing first and second side edges, a top edge, and a bottom edge, the bottom edge of the fourth top panel abutting the top edge of the upper fold section at a line which is suitable for folding, the fourth top panel containing two parallel slits; wherein:

the fourth top panel contains at least one tab located on one or more of its side edges or upper edge, and there is a corresponding slit for each tab (a) at the juncture of the first side panel and the first top panel, (b) at the juncture of the second side panel and the second top panel and (c) at the juncture of the fourth side panel and the third top panel; and further:

(i) the first surface of the first top panel and the fourth top panel present a greeting card message; and (ii) the first surface of the second and third top panels, each of the side panels, and each of the bottom panels and the second surfaces of the first and fourth top panels and the lower and upper fold sections contain decorative designs.

4. A combination gift box and greeting card which is prepared by assembling the blank described in claim 3 and attaching a three-dimensional decorative attachment to the second surface of the fourth top panel by tying an elongated extension of the decorative attachment to the fourth top panel using the parallel slits in the fourth top panel as anchoring means.

5. A blank for a single-piece combination gift box and greeting card comprising:

a sheet member of rigid material having a first surface and a second surface and containing:

(a) a first side panel containing first and second side edges, a top edge, and a bottom edge, the first side edge being connected to a side tab at a line which is suitable for folding;

(b) a second side panel containing first and second side edges, a top edge, and a bottom edge, the second side edge of the first panel and the first side edge of the second panel abutting at a line which is suitable for folding;

(c) a third side panel containing first and second side edges, a top edge, and a bottom edge, the second side edge of the second side panel and the first side edge of the third side panel abutting at a line which is suitable for folding;

(d) a fourth side panel containing first and second side edges, a top edge, and a bottom edge, the second side edge of the third side panel and the first side edge of the fourth side panel abutting at a line which is suitable for folding;

(e) first, second, third, and fourth bottom panels, each bottom panel containing a top edge which abuts the bottom edge of the first, second, third and fourth side panel, respectively, at a line which is suitable for folding, each of said bottom panels containing a tab or a notch, which tabs and notches are so arranged as to form a sturdy bottom when fitted together;

(f) a second top panel and a third top panel, each panel containing a bottom edge, first and second side edges, and a top edge, the top edge of the second side panel and the top edge of the fourth side panel abutting the bottom edge of the second top panel and the bottom edge of the third top panel, respectively, at lines which are suitable for folding, the bottom edge of the second top panel containing a centrally located notch;

(g) a first top panel containing two side edges, a bottom edge, and a top edge, the top edge of the first side panel and the bottom edge of the first top panel abutting at a line which is suitable for folding, the second side edge of the first top panel containing a centrally located notch;

(h) an upper tab panel containing first and second side edges, a bottom edge, and a top edge, the bottom edge of the upper tab panel abutting the top edge of the first top panel at a line which is suitable for folding;

(i) a fourth top panel containing first and second side edges, a top edge, and a bottom edge, the second side edge of the fourth top panel abutting the first side edge of the first top panel at a line which is suitable for folding, said fourth top panel having a tab centrally located on the first side edge, and further:

(i) the first surfaces of the first top panel and the fourth top panel present a greeting card message; and (ii) the first surfaces of the second and third top panels, each of the side panels, each of the bottom panels, the tab panel and the second surfaces of the first and fourth panels contain decorative designs.

6. A combination gift box and greeting card which is prepared by assembling the blank described in claim 5 and permanently adhering a three-dimensional decorative attachment to the second surface of the fourth top panel.

* * * * *